US006595166B2

(12) United States Patent
Batzill

(10) Patent No.: US 6,595,166 B2
(45) Date of Patent: Jul. 22, 2003

(54) COOLING CIRCUIT FOR A MULTI-CYLINDER INTERNAL COMBUSTION ENGINE

(75) Inventor: Manfred Batzill, Neuhausen (DE)

(73) Assignee: Dr. Ing. h.c.F. Porsche AG, Weissach (DE)

( * ) Notice: Subject to any disclaimer, the term of this patent is extended or adjusted under 35 U.S.C. 154(b) by 0 days.

(21) Appl. No.: 10/019,671

(22) PCT Filed: Mar. 29, 2001

(86) PCT No.: PCT/EP01/03572

§ 371 (c)(1),
(2), (4) Date: May 28, 2002

(87) PCT Pub. No.: WO01/83959

PCT Pub. Date: Nov. 8, 2001

(65) Prior Publication Data

US 2002/0189558 A1 Dec. 19, 2002

(30) Foreign Application Priority Data

May 3, 2000 (DE) ..... 100 21 526

(51) Int. Cl.[7] ..... F01P 3/02

(52) U.S. Cl. ..... 123/41.74; 123/41.1

(58) Field of Search ..... 123/41.44, 41.74, 123/41.1

(56) References Cited

U.S. PATENT DOCUMENTS

| | | | |
|---|---|---|---|
| 4,312,304 A | 1/1982 | Tyner | 123/41.74 |
| 4,493,294 A | 1/1985 | Umemura | 123/41.33 |
| 4,953,525 A | 9/1990 | Sakurai et al. | 123/41.28 |

*Primary Examiner*—Noah P. Kamen
(74) *Attorney, Agent, or Firm*—Crowell & Moring LLP

(57) ABSTRACT

A cooling circuit arrangement for a multicylinder internal combustion engine with V-shaped cylinder banks and cooling jackets which surround the cylinder banks and which are provided with cooling liquid by a pump arranged between the two cylinder banks on one of their face sides is disclosed. The pressure-sided connection of the coolant pump, arranged on the one face side of the two cylinder banks, is connected by a coolant pipe to a distributor pipe, arranged on the other face side of the cylinder banks, for the purpose of feeding cooling liquid. A return flow chamber for the coolant from the cooling jackets is arranged between the two cylinder banks adjacent to the pump housing. In this manner the space, existing between the two cylinder banks, is utilized for a part of the coolant arrangement so that the internal combustion engine exhibits a compact design.

15 Claims, 4 Drawing Sheets

COOLING CIRCUIT FOR A MULTI-CYLINDER INTERNAL COMBUSTION ENGINE

The invention relates to a cooling circuit arrangement for an internal combustion engine in accordance with the features of the preamble of claim 1.

Such an arrangement is disclosed in the EP 0 219 351 A2, where the cooling jackets, integrated into the cylinder banks, are provided with cooling liquid by means of a coolant pump, disposed between the V-shaped cylinder banks on one face side of the internal combustion engine. On the other face side of the internal combustion engine there is a collecting pipe for the coolant, flowing back from the cylinders and a radiator circulation. Owing to the collecting pipe, provided with several connections, the actual dimensions of the internal combustion engine are exceeded so that, especially when the motor is installed lengthwise into the vehicle, there is a demand for construction space that the passenger space no longer has to offer.

Thus, the invention is based on the problem of providing a structural arrangement for a cooling circuit in an internal combustion engine with cylinders arranged in the shape of a V. In this arrangement the existing free space is utilized so that the actual dimensions of the internal combustion engine are not exceeded.

The invention solves this problem with the characterizing features of claim 1.

Since the space existing between the two cylinder banks is used for a part of the coolant arrangement, the internal combustion engine exhibits a compact design that is especially appropriate for longitudinal installation into a motor vehicle. On the face side, assigned to the coolant distributor pipe, it is possible to attach in a simple manner a transmission to the internal combustion engine, since none of the parts of the cooling circuit arrangement impede access during installation.

Other advantages and advantageous further developments of the invention are disclosed in the dependent claims and the description.

The cylinder block and the cylinder head are cooled, as required, by means of the parallel, i.e. the simultaneous, coolant flow through the cylinder block and the cylinder head housing without any additional control systems. The motor reaches quickly its operating temperature. Thus, the cold running phase is reduced; and consequently the fuel consumption and the raw emissions can be reduced. Due to the parallel division of the coolant flow, the cross sections of the cooling channels in the cylinder block can be decreased so that the construction space and thus also the weight of the internal combustion engine can be further decreased. In contrast to serial coolant flow through the cylinder block and the cylinder head, the pressure loss in the cooling circuit decreases, thus making it possible to select less input power for the water pump.

With the aid of the two return flow chambers, which are disposed at the coolant pump and which are connected together by means of an opening, which can be controlled by a thermostat, a regulator can be realized that can be built compactly between the two cylinder banks and with which a small and large coolant circulation and a heating circulation can be operated. Since in the installed state of the internal combustion engine in the vehicle, the regulator and the coolant pump are arranged, seen in the direction of travel, on the front face side of the internal combustion engine, it is readily accessible for maintenance and repair work.

The bottom part of the two return flow chambers, which consist of one module, is cast in an advantageous manner together with the housing of the coolant pump in the upper part of the crankcase.

One embodiment of the invention is explained in detail in the following description and the drawings.

DESCRIPTION OF THE EMBODIMENT

Figure 1:
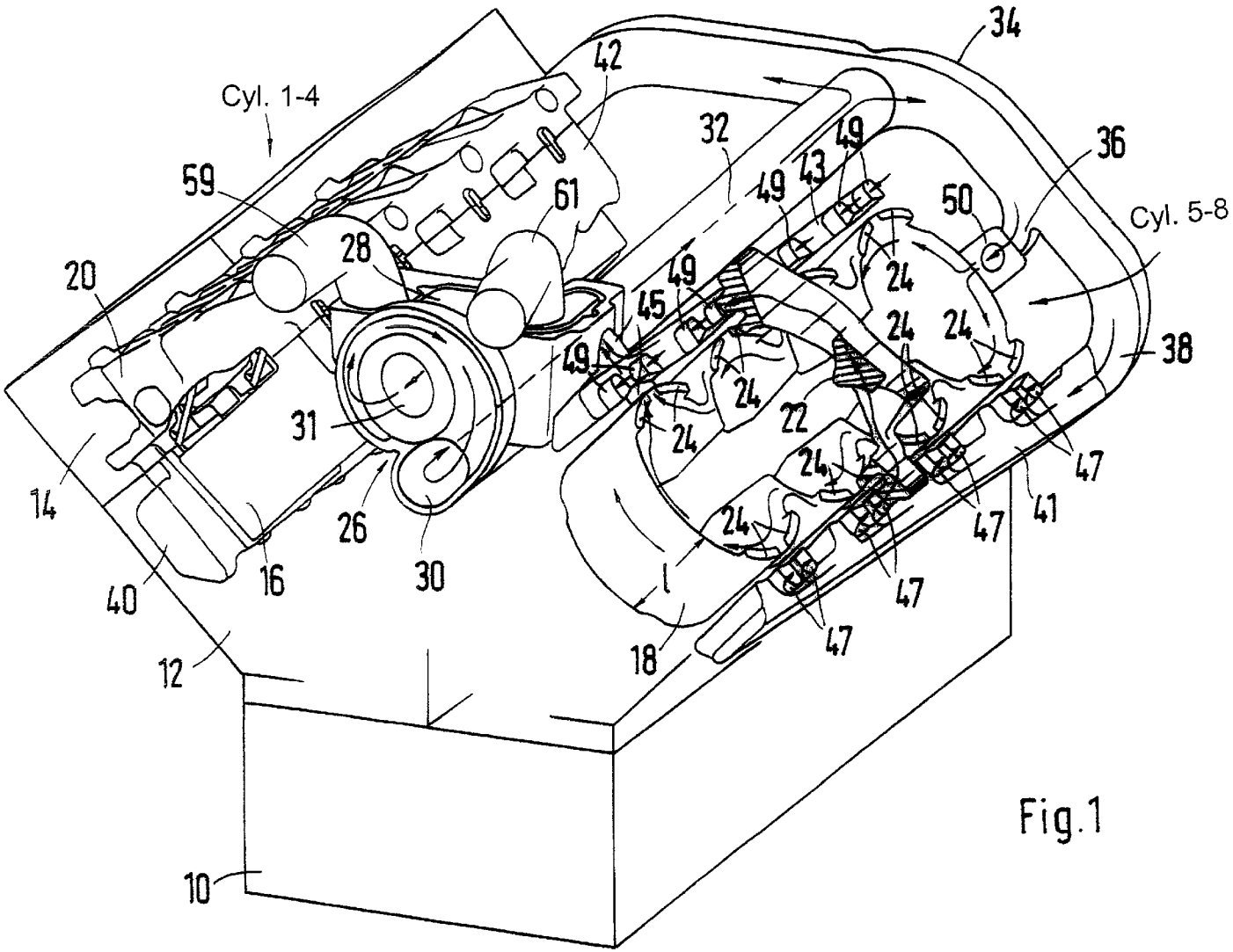
FIG. 1 is a schematic general view of an internal combustion engine.
Figure 2:
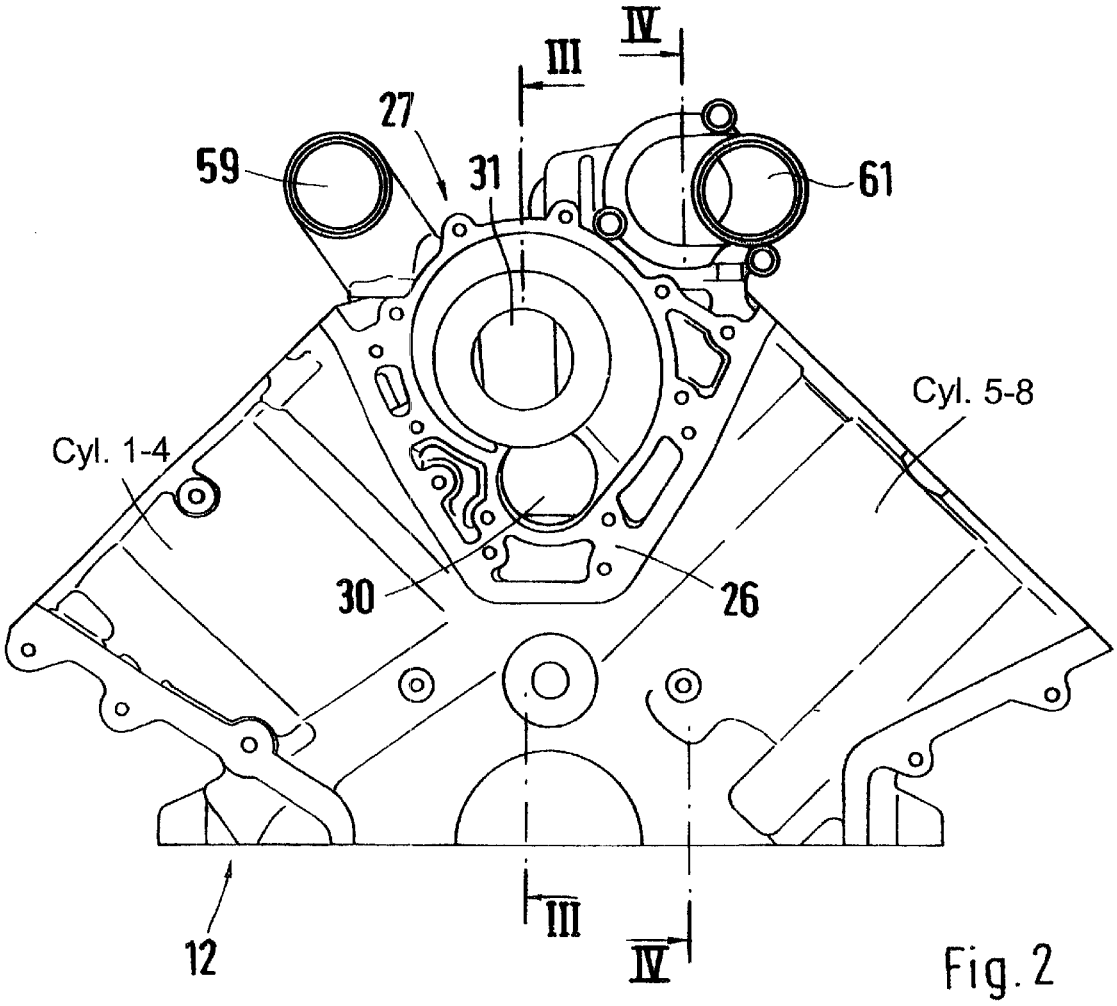
FIG. 2 is a front view of the internal combustion engine, designed as a V engine.
Figure 3:
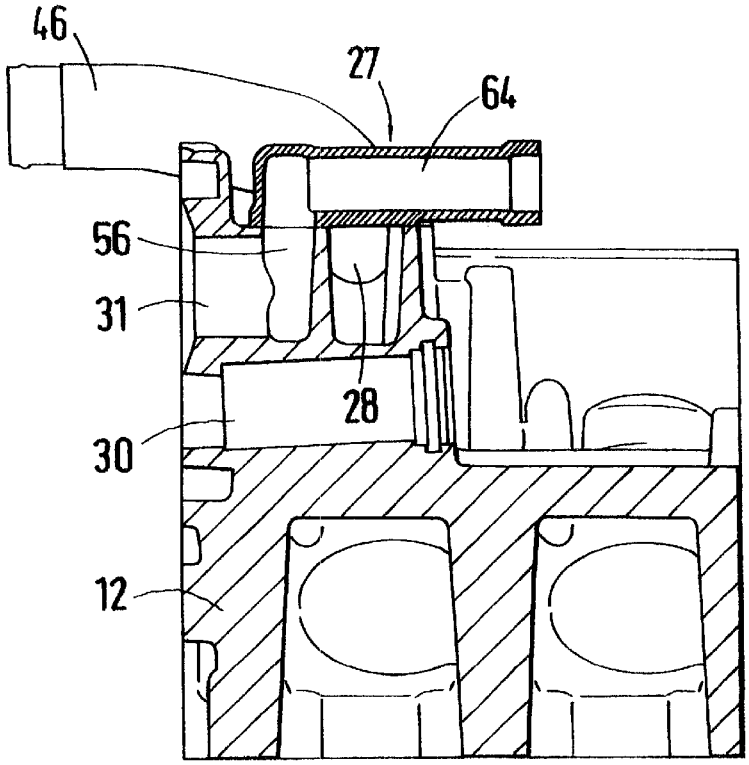
FIG. 3 is a sectional view along the line III—III in FIG. 2.
Figure 4:
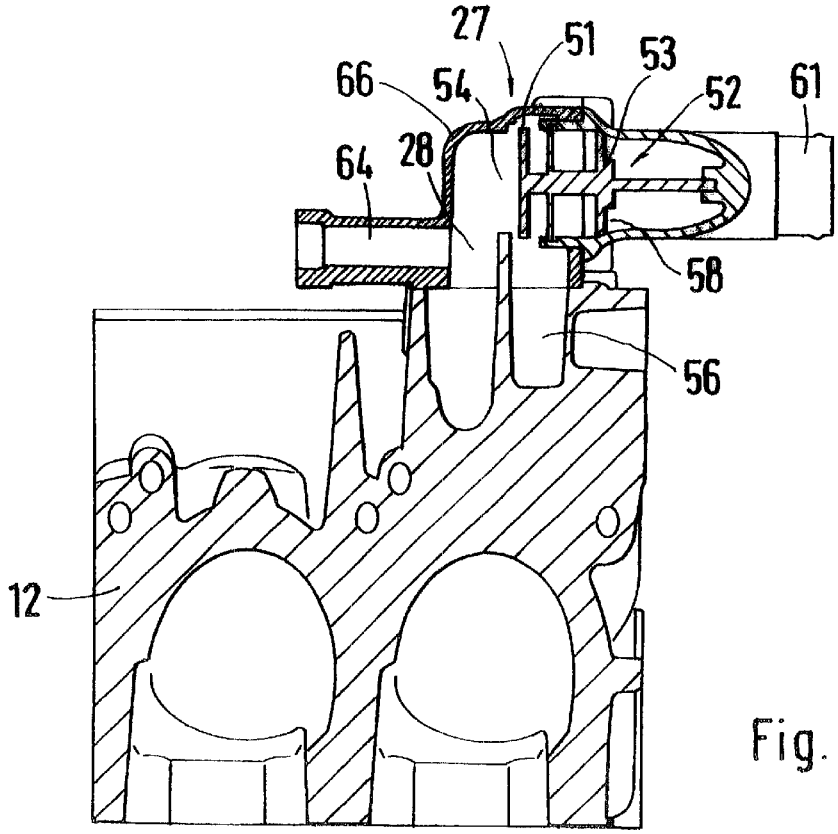
FIG. 4 is a sectional view along the line IV—IV in FIG. 2.

The V8 engine, depicted in FIG. 1, consists of a crankcase bottom part 10 and a crankcase upper part 12, in which two rows of cylinders 1 to 4 and 5 to 8 are arranged with respect to each other in the shape of a V. For each row of cylinders a cylinder head housing 14 adjoins the upper part 12 of the crankcase. Both rows of cylinders are identical in their construction. In FIG. 1 only the cylinder head housing 14 is illustrated for the row of cylinders 1 to 4 (on the left in the drawing), whereas for the right row of cylinders (cylinders 5 to 8) the cylinder head housing is not shown for the sake of a better overview of the coolant flow. Both rows of cylinders have cylinder cooling jackets 16 and 18, surrounding the cylinder bearing surfaces, whereby the cylinder cooling jackets 16, 18 are assigned only to the upper area of the cylinder bearing surfaces. The length 1 of the cylinder cooling jackets 16, 18 amounts to approximately ½ the total length of the individual cylinders or cylinder bearing surfaces. The slotted openings 24, arranged on the face side of the cylinder cooling jackets 16, 18, are sealed with the aid of a cylinder head seal (not illustrated). The cylinder head housing 14 also has cooling jackets, which are called hereinafter the cylinder head cooling spaces 20, 22. For the sake of a better overview of the cylinder head cooling spaces 20, 22, the cross section 22 of the cooling space is shown for the right row of cylinders (cylinders 5 to 8).

Between the two rows of cylinders is arranged the spiral-shaped housing 26 of a water pump, whereby the cover portion (not illustrated) of the water pump accommodates the crankshaft-driven turbine wheel to generate the coolant flow. Behind the housing 26 of the water pump is a module 27, exhibiting, among other things, a return flow chamber 28, which forms, as will be described below in detail, the return flow of the coolant from the cylinder cooling jackets 16, 18 and the cylinder head cooling spaces 20, 22.

The pressure sided outlet 30 of the water pump housing 26 is connected to a coolant distributor pipe 34 by way of a coolant pipe 32, extending between the two rows of cylinders to the other face side of the internal combustion engine. The coolant distributor pipe 34 has for each row of cylinders two connections 36, 38, which are designed as connecting tubes and which are shown only for the right row of cylinders (cylinders 5 to 8) in FIG. 1. The first connecting tubes 36 are connected to the cooling jackets 16, 18, which are disposed in the cylinder block and through which the flow runs longitudinally, whereas the second connecting tubes 38 are connected to the external longitudinal coolant channels 40, 41, cast into the upper part 12 of the crankcase. The external longitudinal coolant channels 40, 41 exhibit inlet openings 47, which are assigned to the individual cylinder head units and through which the coolant is passed into the cylinder head cooling spaces 20, 22. From there, the coolant flows across the cylinder head housing 14 and then it also passes into internal longitudinal coolant channels 42, 43, which are cast into the upper part 12 of the crankcase and provided with outlet openings 49. The outlet sided end of the internal longitudinal coolant channels 42, 43 and the outlet sided end of the two cylinder cooling jackets 16, 18 lead by way of joint outlets, designed as overflow boreholes 44, 45, into the return flow chamber 28. The overall dimensions, in particular the longitudinal stretch of the internal combustion engine, is not altered by the arrangement of the coolant distributor pipe 34, the connecting tubes 36, 38 and the return flow chamber 28. At the same time it is possible to attach in a simple manner a transmission on the face side of the internal combustion engine facing the coolant distributor pipe 34.

Figure 5:
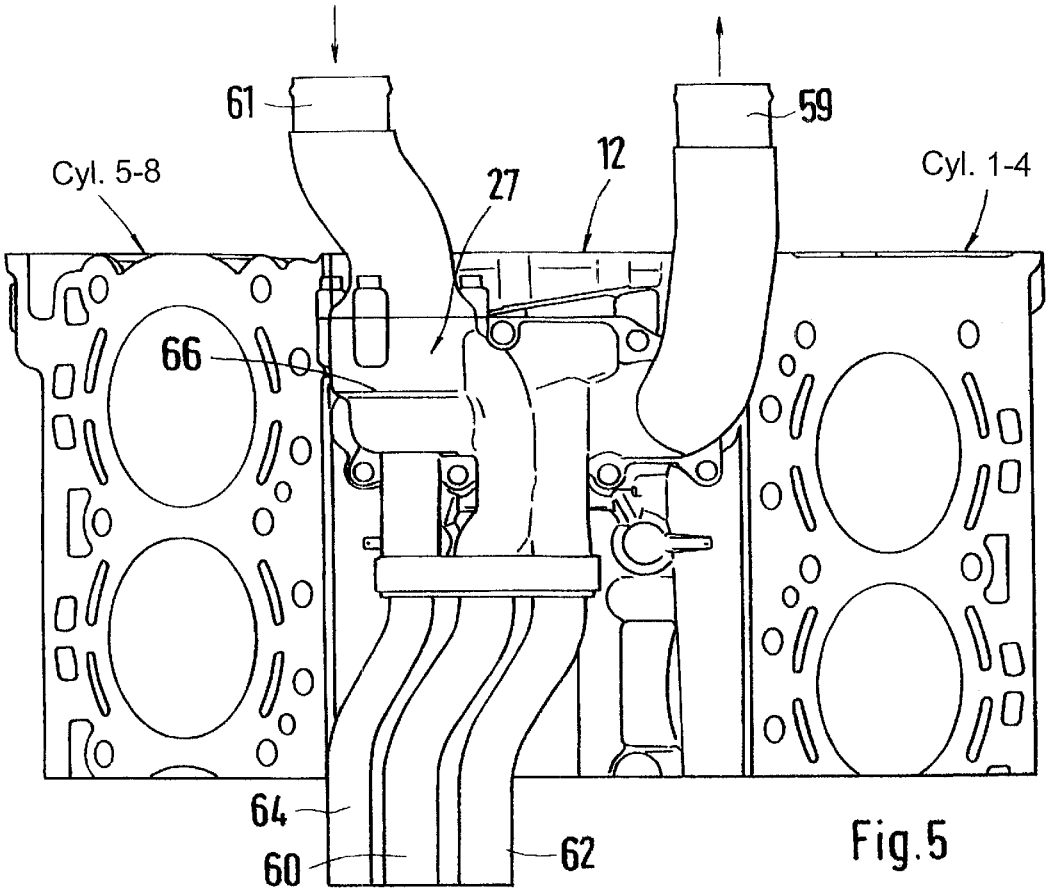
FIGS. 5 and 6 are two top views of a detail of the internal combustion engine.
Figure 6:
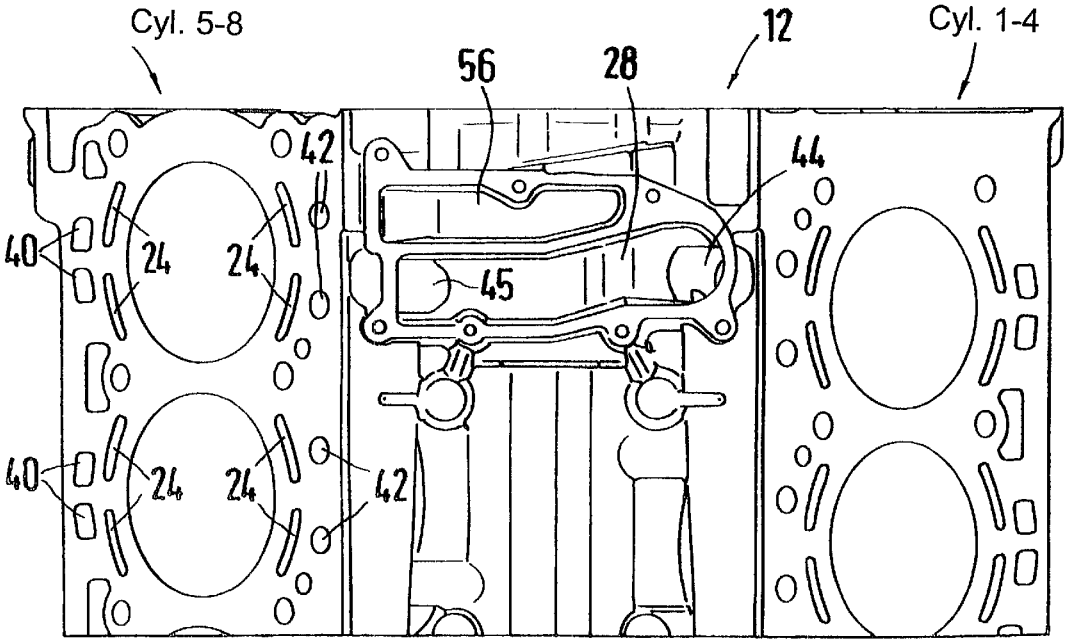

As shown in detail in FIGS. 2 to 6, the module 27 exhibits, besides the return flow chamber 28, a second return flow chamber 56, which is connected to the first return flow chamber 56 and to the intake pipe 31 of the pump housing 26 by way of an opening 54, controlled by a first valve disk 51 of a thermostat 52. The module 27, comprising the two return flow chambers 28 and 56 and the thermostat 52, is constructed as two parts, whereby the bottom part of the module 27 is cast together with the pump housing 26 in the crankcase upper part 12 between the two cylinder banks. The housing cover 66 of the module 27 accommodating the thermostat 52 is screwed to the bottom part of the module 27. The second valve disk 53 of the thermostat 52 controls a return flow opening 58, leading to the second return flow chamber 56, whereby the fitting 59, connected to the first return flow chamber 28, forms the fore-flow; and the fitting 61, connected to the second return flow chamber 56, forms the return flow of a radiator circulation, which is not depicted in detail. As shown in FIG. 5, the second return flow chamber 56 is also connected to the return flow line 60 of a heating circuit (not depicted in detail) and a line 62, which leads to an expansion tank. Starting from the first return flow chamber 28, a line 64 forms the heating fore-flow.

The coolant circulation, which is actuated in the warming up phase of the motor and which is referred to below as the small coolant circulation, functions as follows.

In this operating phase the opening 54 between the first return flow chamber 28 and the second return flow chamber 56 is released by means of the first valve disk 51 of the thermostat 52 (see FIG. 4) so that the coolant passes from the first return flow chamber 28 into the second return flow chamber 56. From there it is conveyed through the intake pipe 31 of the water pump housing 26 into the coolant pipe 32 and through the coolant distributor pipe 34 to the cylinder cooling jackets 16, 18, arranged in the cylinder block, and through the external longitudinal coolant channels 40, 41 to the cylinder head cooling spaces 20, 22, arranged in the cylinder head housings 14. On the inlet side there is a throttle 50 in the cylinder cooling jackets 16, 18. With the aid of the throttle the flow resistance is coordinated in such a manner that 70 to 80%, preferably 75% of the coolant flow, put into circulation for cooling the motor, passes through the external longitudinal coolant channels 40, 41 into the cylinder head housing 14. The cited percentage of coolant flow that is distributed guarantees that the cylinder head housing 14, which is subjected to a high temperature load, and the cylinder block are adequately cooled. After the coolant has flowed through the cylinder cooling jackets 16, 18 and the cylinder head cooling spaces 20, 22 of both rows of cylinders, the coolant is guided back again into the first return flow chamber 28 by way of the joint overflow boreholes 44, 45.

In addition to the small coolant circulation described above, upon reaching the operating temperature, the internal combustion engine is switched over to a large coolant circulation, in which the radiator circulation is included, as well-known. In this case the opening 54 is closed by means of the first valve disk 51 of the thermostat 52, whereas the opening 58, controlled by the second valve disk 53, is released for the radiator circulation. Thus, the radiator circulation is actuated in that, after the coolant has passed through the coolant circuit, the coolant flows by way of the fore-flow fitting 59, the radiator (not illustrated), and the return flow fitting 61 into the second return flow chamber 56.

What is claimed is:

1. A cooling circuit arrangement for a multicylinder internal combustion engine with V-shaped cylinder banks and cooling jackets, which surround the cylinder banks and which are provided with coolant by a pump, arranged between the two cylinder banks on one of their face sides, wherein a pressure-sided connection of the pump, arranged on the one face side of the two cylinder banks, is connected by a coolant pipe to a distributor pipe, arranged on the other face side of the cylinder banks, for supplying coolant and wherein a return flow chamber for the coolant from the cooling jackets is arranged between the two cylinder banks adjacent to a pump housing.

2. The cooling circuit arrangement, as claimed in claim 1, wherein the distributor pipe includes four connections, and wherein two connections each are connected to the cooling jackets of a cylinder bank.

3. The cooling circuit arrangement, as claimed in claim 2, wherein for each cylinder bank a first connection is connected to one cylinder cooling jacket and for each cylinder bank a second connection is connected to a cylinder head cooling space.

4. The cooling circuit arrangement, as claimed in claim 3, wherein the coolant flows across the cylinder head cooling space by way of an external longitudinal coolant channel, which is connected to the second connection and which includes inlet openings which are assigned to individual cylinder head units and which lead into the cylinder head cooling space.

5. The cooling circuit arrangement, as claimed in claim 4, wherein an internal longitudinal coolant channel is connected on an output side to the cylinder head cooling space by way of outlet openings arranged in the internal longitudinal coolant channel.

6. The cooling circuit arrangement, as claimed in claim 1, wherein a second return flow chamber borders the return flow chamber, wherein both are connected by an opening which can be controlled by a thermostat, and wherein the second return flow chamber includes an opening for connection of a radiator circulation which can also be controlled by the thermostat.

7. The cooling circuit arrangement, as claimed in claim 6, wherein the first return flow chamber is connected to a fore-flow connection and wherein the second return flow chamber is connected to a return flow connection for a heating circulation.

8. The cooling circuit arrangement, as claimed in claim 6, wherein the second return flow chamber exhibits a return flow connection for a water circulation, provided with an expansion tank.

9. The cooling circuit arrangement, as claimed in claim 6, wherein the two return flow chambers consist of a two part module, wherein a housing cover of the module accommodates the thermostat.

10. The cooling circuit arrangement, as claimed in claim 9, wherein a bottom part of the module is cast together with the pump housing in an upper part of a crankcase.

11. A method for cooling a multicylinder internal combustion engine with V-shaped cylinder banks and cooling jackets which surround the cylinder banks, comprising the steps of:

pumping cooling liquid by a pump through a coolant pipe to a distributor pipe, wherein the pump is disposed between the two cylinder banks and at one face side of the two cylinder banks and wherein the coolant pipe is disposed between the two cylinder banks and further wherein the distributor pipe is disposed on an opposing face side of the two cylinder banks;

distributing the cooling liquid to a cooling jacket of each of the cylinder banks by the distributor pipe; and returning the cooling liquid from the respective cooling jackets to a return flow chamber, wherein the return flow chamber is disposed between the two cylinder banks and adjacent to a pump housing of the pump.

12. The method of claim 11, wherein for each cylinder bank, the distributor pipe distributes the cooling liquid to a cylinder cooling jacket and a cylinder head cooling space, wherein the cooling liquid flowing through the cylinder cooling jacket runs parallel to the cooling liquid flowing through the cylinder head cooling space.

13. The method of claim 12, wherein the cooling liquid is distributed to the cylinder cooling jacket by the distributor pipe through a first connection and wherein the cooling liquid is distributed to the cylinder head cooling space by the distributor pipe through a second connection.

14. The method of claim 13, wherein the cooling liquid flows across the cylinder head cooling space by way of an external longitudinal coolant channel.

15. The method of claim 11, wherein a second return flow chamber borders the return flow chamber and wherein both chambers are connected by an opening controlled by a thermostat and wherein the second return flow chamber includes an opening for connection of a radiator circulation which can also be controlled by the thermostat.

* * * * *